US009663937B2

(12) United States Patent
Goldman

(10) Patent No.: US 9,663,937 B2
(45) Date of Patent: May 30, 2017

(54) MODULAR HOUSING AND METHOD OF INSTALLATION IN A STRUCTURAL FRAMEWORK

(76) Inventor: Gary B. Goldman, North Miami Beach, FL (US)

( * ) Notice: Subject to any disclaimer, the term of this patent is extended or adjusted under 35 U.S.C. 154(b) by 1140 days.

(21) Appl. No.: 12/134,532

(22) Filed: Jun. 6, 2008

(65) Prior Publication Data

US 2009/0019811 A1 Jan. 22, 2009

Related U.S. Application Data

(60) Provisional application No. 60/942,540, filed on Jun. 7, 2007.

(51) Int. Cl.
*E04H 12/00* (2006.01)
*E04B 1/00* (2006.01)
*E04B 1/348* (2006.01)

(52) U.S. Cl.
CPC ..... *E04B 1/3483* (2013.01); *E04B 1/34807* (2013.01)

(58) Field of Classification Search
CPC ..... E04B 1/3483; E04B 1/34807
USPC ..... 52/79.7, 79.8, 79.9, 79.12, 79.13, 143, 52/126.5, 126.7, 745.02, 745.03, 745.1, 52/745.13; 220/1.5, 629; 296/35.3
See application file for complete search history.

(56) References Cited

U.S. PATENT DOCUMENTS 2,334,124 A * 11/1943 Gilbert ..... 414/536
3,000,061 A * 9/1961 Cooper ..... 52/29
3,260,028 A * 7/1966 Lee ..... 52/745.04
3,474,580 A 10/1969 Smeeth
3,541,744 A 11/1970 Maxwell
3,604,166 A 9/1971 Ciccarelli
3,623,296 A * 11/1971 Santoro ..... 52/79.12
3,638,380 A * 2/1972 Perri ..... 52/79.12
3,707,811 A 1/1973 Hampson
3,712,008 A * 1/1973 Georgiev et al. ..... 52/79.12
3,758,998 A 9/1973 Ollis et al.
3,823,520 A * 7/1974 Ohta et al. ..... 52/73
3,977,536 A 8/1976 Moore et al.
3,982,732 A * 9/1976 Pender ..... 414/10
4,059,931 A * 11/1977 Mongan ..... 52/79.12
4,102,097 A 7/1978 Zalotay
4,288,950 A 9/1981 Agassi et al.
4,545,158 A * 10/1985 Rizk ..... 52/79.1
4,545,159 A 10/1985 Rizk
4,545,171 A 10/1985 Colvin
4,594,817 A 6/1986 McLaren et al.
4,635,412 A 1/1987 Le Poittevin
4,644,708 A 2/1987 Baudot et al.
4,723,381 A 2/1988 Straumsnes
4,741,133 A 5/1988 Kutzner
(Continued)

OTHER PUBLICATIONS

Website information from Sekisuiheim Chemical Co. Ltd on the Sekisui Helm Production Process and the Two-U Home Production Process—www.sekisuiheim.com/english/index.html.
(Continued)

*Primary Examiner* — Brent W Herring
(74) *Attorney, Agent, or Firm* — Patents on Demand P.A.; Brian K. Buchheit; Scott M. Garrett

(57) ABSTRACT

A tubular steel frame housing module built in a factory and then transferred within a standard intermodal shipping container for installation within a structural framework at a remote building site.

15 Claims, 16 Drawing Sheets

(56) References Cited

U.S. PATENT DOCUMENTS

| | | | | | |
|---|---|---|---|---|---|
| 4,766,708 | A | | 8/1988 | Sing | |
| 4,779,514 | A | | 10/1988 | Prigmore et al. | |
| 4,779,552 | A | * | 10/1988 | Harsia et al. | 114/65 R |
| 4,854,094 | A | | 8/1989 | Clark | |
| 4,891,919 | A | | 1/1990 | Palibroda | |
| 4,910,932 | A | * | 3/1990 | Honigman | 52/280 |
| 5,232,204 | A | * | 8/1993 | Nunez | 254/133 A |
| 5,233,808 | A | * | 8/1993 | Salmenmaki et al. | 52/745.02 |
| 5,257,440 | A | | 11/1993 | Bardou et al. | |
| 5,317,857 | A | | 6/1994 | Allison | |
| 5,447,000 | A | | 9/1995 | Larsen | |
| 5,528,866 | A | * | 6/1996 | Yulkowski | 52/79.12 |
| 5,596,844 | A | | 1/1997 | Kalinowski | |
| 5,755,063 | A | | 5/1998 | Ohnishi et al. | |
| 5,765,316 | A | | 6/1998 | Kavarsky | |
| 5,950,373 | A | * | 9/1999 | von Hoff et al. | 52/79.5 |
| 6,016,634 | A | * | 1/2000 | Sayer | 52/648.1 |
| 6,463,705 | B1 | | 10/2002 | Davis et al. | |
| 6,470,630 | B1 | * | 10/2002 | Miyamoto | 52/64 |
| 6,925,761 | B1 | * | 8/2005 | De La Marche | 52/79.7 |
| 6,959,515 | B1 | | 11/2005 | Beighton | |
| 6,983,567 | B2 | | 1/2006 | Ciotti | |
| 7,100,332 | B2 | | 9/2006 | Loesch | |
| 7,121,061 | B2 | * | 10/2006 | Jazzar | 52/745.13 |
| 7,594,361 | B2 | * | 9/2009 | Tragant Ruano | 52/79.9 |
| 2002/0007602 | A1 | * | 1/2002 | Corcoran | 52/122.1 |
| 2002/0007605 | A1 | * | 1/2002 | Cohen et al. | 52/238.1 |
| 2002/0116878 | A1 | | 8/2002 | Ciotti | |
| 2005/0108957 | A1 | * | 5/2005 | Quesada | 52/143 |
| 2006/0059792 | A1 | | 3/2006 | Tiramani | |
| 2006/0080929 | A1 | | 4/2006 | Lima | |
| 2007/0215568 | A1 | * | 9/2007 | Heinrichs et al. | 211/191 |

OTHER PUBLICATIONS

Website inforamtion on Marmol Radziner Prefab factory built homes—www.marmolradzinerprefab.com/main.html.

* cited by examiner (SECTION A–A OF FIG.2)

MODULAR HOUSING AND METHOD OF INSTALLATION IN A STRUCTURAL FRAMEWORK

INDEX TO RELATED APPLICATIONS

This application claims the benefit of U.S. Provisional Patent Application No. 60/942,540, filed Jun. 7, 2007, the disclosure of which is incorporated herein by reference in its entirety.

BACKGROUND OF THE INVENTION

It is desirable and a feature of the present invention, to transport a prefabricated structure, manufactured in a factory and ready for habitation, in an intermodal shipping container, to a remote building site. It is further desirable that the construction of the prefabricated structure take place in a factory to realize considerable cost savings.

The U.S. Department of Housing and Urban Development classifies factory built housing as panelized housing, precut housing, manufactured housing and modular housing. Of interest in the present invention is modular housing, defined by the U.S. Department of Housing and Urban Development as a factory-built home of one or more units typically using platform-frame construction. These multi-room, three-dimensional units are pre-assembled complete with trim and finishes. Upon completion at the factory, these units are shipped to the site for installation on permanent foundations (e.g. typically a concrete slab cast in place). Modular housing must comply with the building codes in the jurisdiction of their permanent foundation.

The present invention installs the module within a structural framework.

BRIEF SUMMARY OF THE INVENTION

The present invention is a tubular steel frame housing module designed to be built in a factory and then inexpensively and easily transferred to a building site within an ISO "high cube" intermodal shipping container. In the present invention, a standard "high cube" container is preferred. The module may be for prefabricated housing and there may be multiple modules to be combined at a remote location from a factory where the modules are manufactured. The modules are transported from the factory within intermodal containers. In a preferred embodiment, the modules may be complete or substantially complete having any one or all of, outer cladding (including, but not limited to doors and windows), interior walls (painted, wallpapered, decorated or unfinished), flooring, electrical wiring, electrical connections, plumbing, plumbing connections, lighting fixtures, plumbing fixtures, kitchen fixtures and appliances, and the like.

A typical residence has a floor to ceiling distance of approximately 8 feet. The module of the present invention is loaded onto a shipping container and fits under the door header of conventionally used containers, which is typically about 8 feet 5 inches. The interior floor to ceiling distance of a module of the present invention may be between 7 feet 6 inches and 8 feet. In a preferred embodiment, the interior floor to ceiling distance is between 7 feet 9 inches and 7 feet 11 inches.

At the building site, the modules are secured into a precast concrete frame structure or a steel frame structure. Multiple modules may be joined to one another to form a larger enclosed area. Each housing module will include where appropriate exterior walls, windows and doors, external wall cladding, a sub-floor system, a ceiling and interior walls.

In a preferred embodiment, a roof is placed on the building structural frame support prior to delivery of the modules. The uppermost module is installed first. A second module is installed below the first installed module and workers may access the electrical and plumbing connections in the space between the two modules. The sequence of installation is repeated in this order until all modules have been installed. It is preferred that all electrical, plumbing, and other connections are close to an outer edge such that they may be easily accessed for connection.

DESCRIPTION OF THE PREFERRED EMBODIMENT

The prefabricated housing module is made of a tubular steel frame. The frame for the module is made of 3½"×3½" (also 3½ inch by 3½ inch, where the " means or designates inches) structural tubing. Frame 11 includes four longitudinal tubular beams 12, 13, 14 and 15 that run the length of module 11, whether continuous, or several beams connected end to end, one to the other, as known in the art.

Vertical columns 17, 18, 19 and 20 are 3"×3" structural tubes and are located at the corners of module 11. There are two sets of vertical intermediate 3"×3" structural tube columns 21*a*, 21*b*, 22*a*, and 22*b*. There may be additional sets of vertical columns as needed or desired. The upper portion of module 11 has inner upper frame supports 21*c* and 22*c* and may have more supports if desired. Each end of module 11 has outer upper frame supports 24*c* and 24*d*.

Figure 11:
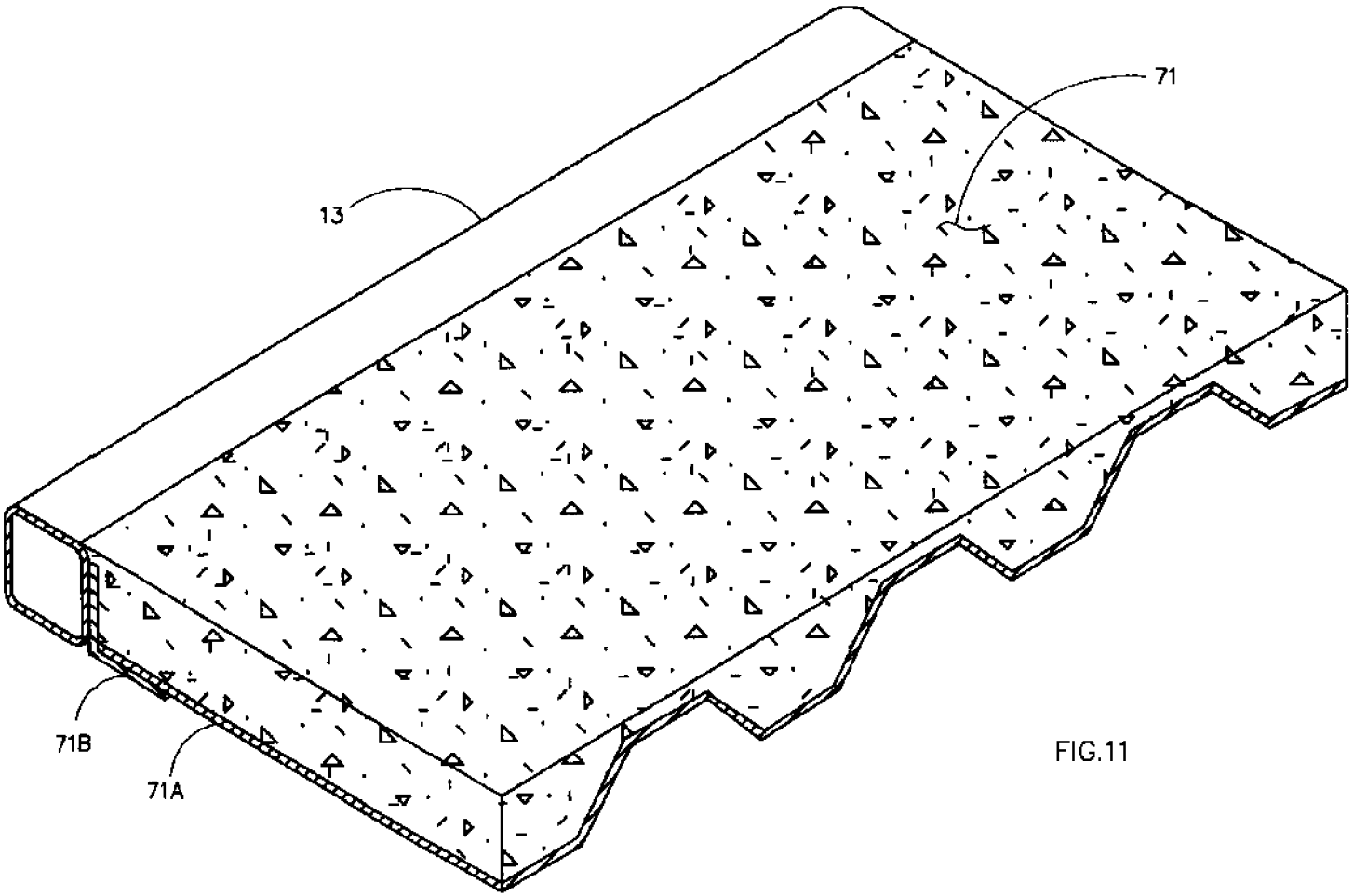
FIG. 11 is a partial perspective view of the lightweight concrete flooring.

As shown in FIG. 11, module 11 may include flooring 71 made of lightweight concrete that is within steel support 71*a*. Steel support 71*a* is supported by brackets 71*b* that connects to each of longitudinal beams 13 (shown in FIG. 11) and longitudinal beam 12 (not shown in this partial view). Exterior cladding 26 will be attached to the walls and will have door cavities 26*a*, window cavities 26, and will be provided the appropriate doors and windows. Module 11 will have ceiling 27.

Frame 11 is built on an assembly line in a factory location. Within the factory, frame 11 can be supported on and moved around on various roller or caster mechanisms including pneumatic air casters. A preferred mechanism is a ball transfer caster 25. In a preferred embodiment, the ball transfer caster 25 may be removable from module 11 as desired.

Figure 5:
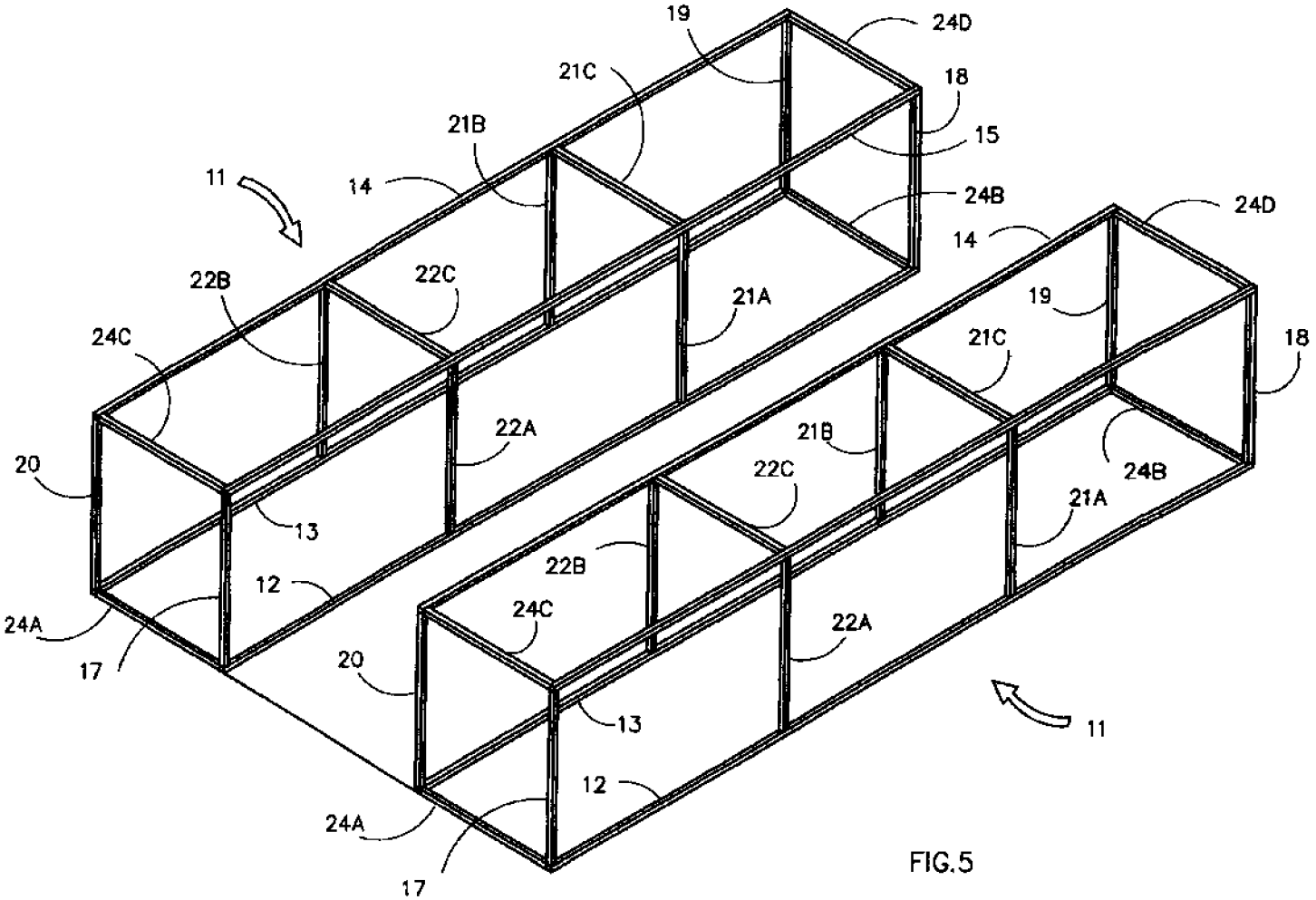
FIG. 5 is a perspective view of two modules.
Figure 6:
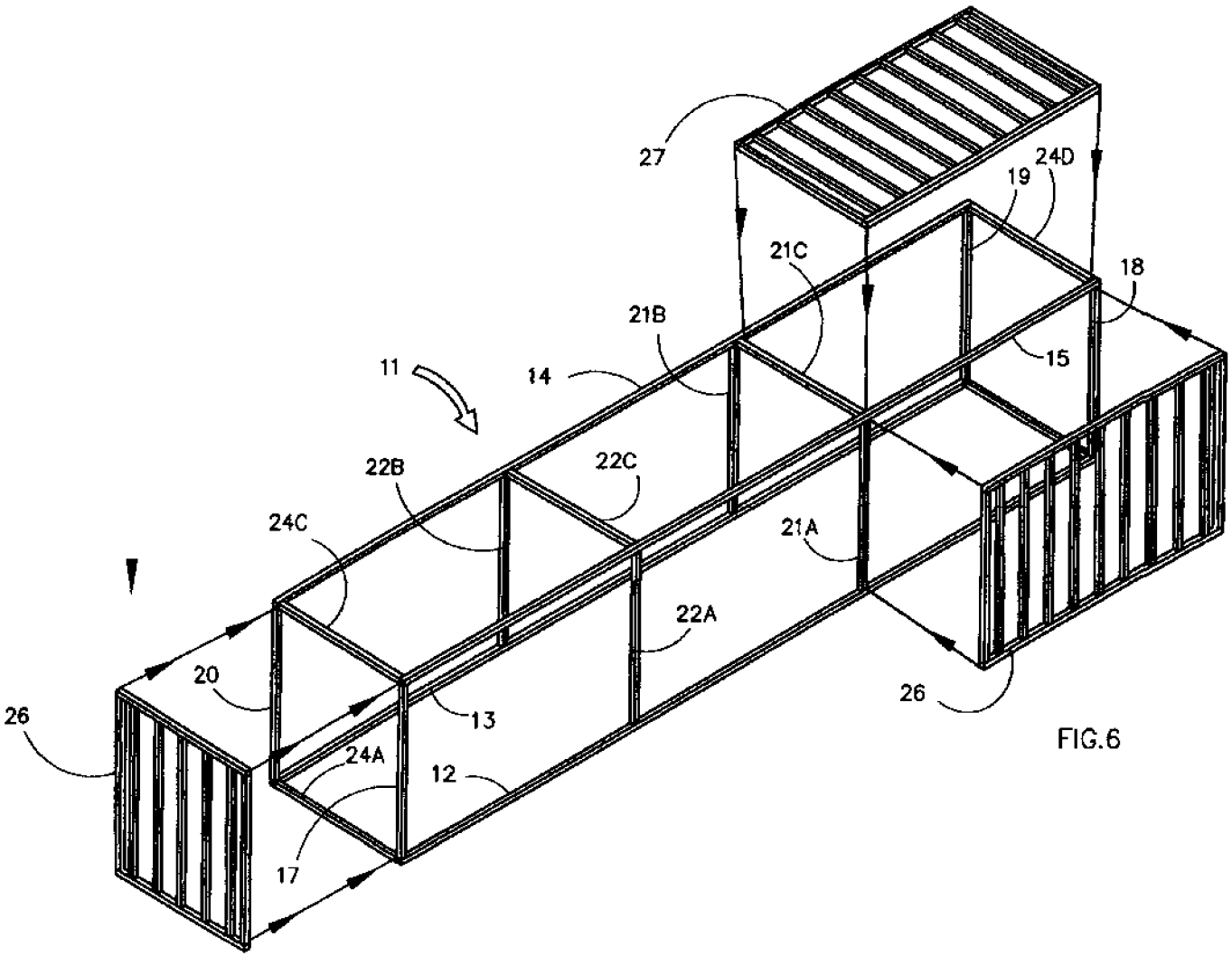
FIG. 6 is a module with exterior cladding removed.
Figure 7A:
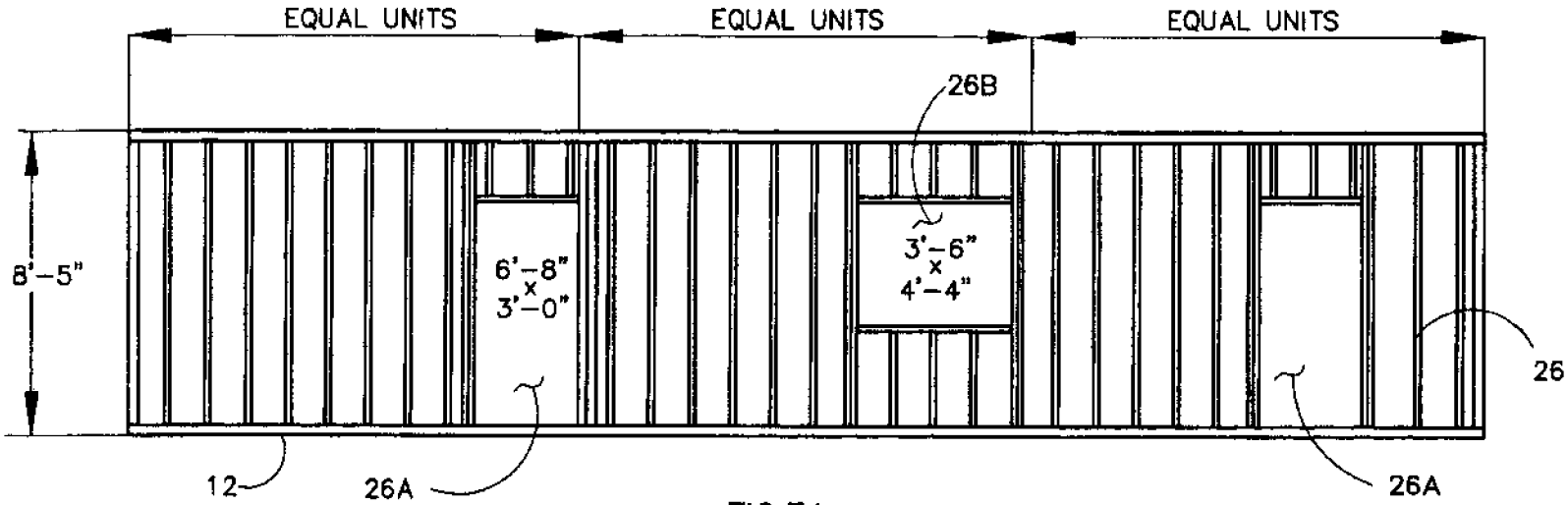
FIG. 7A is a side view of a module with exterior cladding.
Figure 7C:
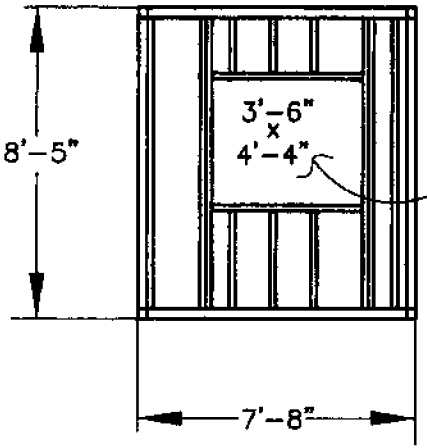
FIG. 7C is still another view of a module with exterior cladding.
Figure 7B:
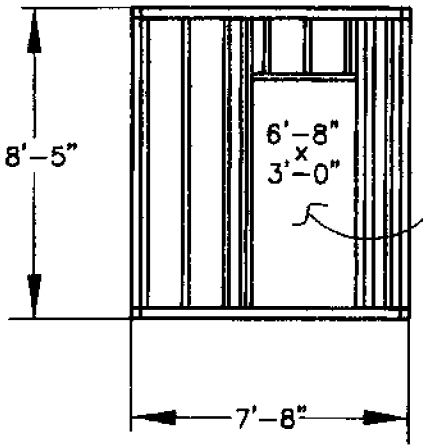
FIG. 7B is another view of a module with exterior cladding.

Module 11, either during or after completion of the construction process, is placed upon a loading platform equal in floor height to the floor height of the intermodal shipping container 40. During construction, ball transfer casters 25 are placed in predetermined positions under the steel frame of the module. In a preferred embodiment, ball transfer casters are placed under each corner and under each longitudinal beam 12 and 13 in pairs on either side of the intersection with vertical beams 21*a*, 21*b*, 22*a*, and 22*b* along ball transfer placement points 1*a*, 1*b*, 1*c*, 1*d*, 1*e*, 1*f*, 1*g*, and 1*h* as shown in FIG. 5.

These ball transfers 25 enable the module to be moved about and into the shipping container. It is intended that a guide system may be used to keep module 11 centered within container 40 when it is being moved into intermodal container 11. It is anticipated that the ball transfers 25 will then be removed after module 11 is within the building frame and prior to final installation. The ball transfers are then returned to the factory for re-use.

In a preferred embodiment, ball transfers 25 extend below the outer periphery of longitudinal beams 12 and 13 less than about one inch. In a preferred embodiment, ball transfers 25 extend below the outer periphery of beams 12 and 13 about one-quarter inch. Module 11 is supported by and moves on ball transfers 25 in the factory, when loaded into container 40, and when unloaded and moving along joists 81 as will be detailed herein.

Intermodal container 40 used in the present invention, is a standard "high cube" ISO shipping container meaning it has 8'5" clear height at the door header of intermodal container 40, and 7'8" clear width on the inside of intermodal container 40. It is anticipated that container 40 could have doors (not shown) at both ends.

When the module 11 is loaded within container 40 it can then be shipped anywhere in the world to a building site where the module 11 will be unloaded and secured into a building support structure 100.

At a building site, a building structural frame support 100 having vertical beams 50 and horizontal beams 53, is constructed, preferably prior to the arrival of module 11. The building structural frame support can be made any appropriate and desired material that may include pre-cast concrete or structural steel.

The building structural frame support 100 can be of multiple stories, and as wide as desired. The present invention has made an improvement over current modular buildings which rely on the modular building frames for structural support and are limited in the amount of stories in which they may be used. Typically, current structural modular buildings that are stacked one on top of another are limited to a height of 5 to 7 stories. The present system has no upper limit on the number of stories because the support for the overall structure is provided by building structural frame support 100 and does not rely on the frame of individual modules 11 for structural support.

Figure 16:
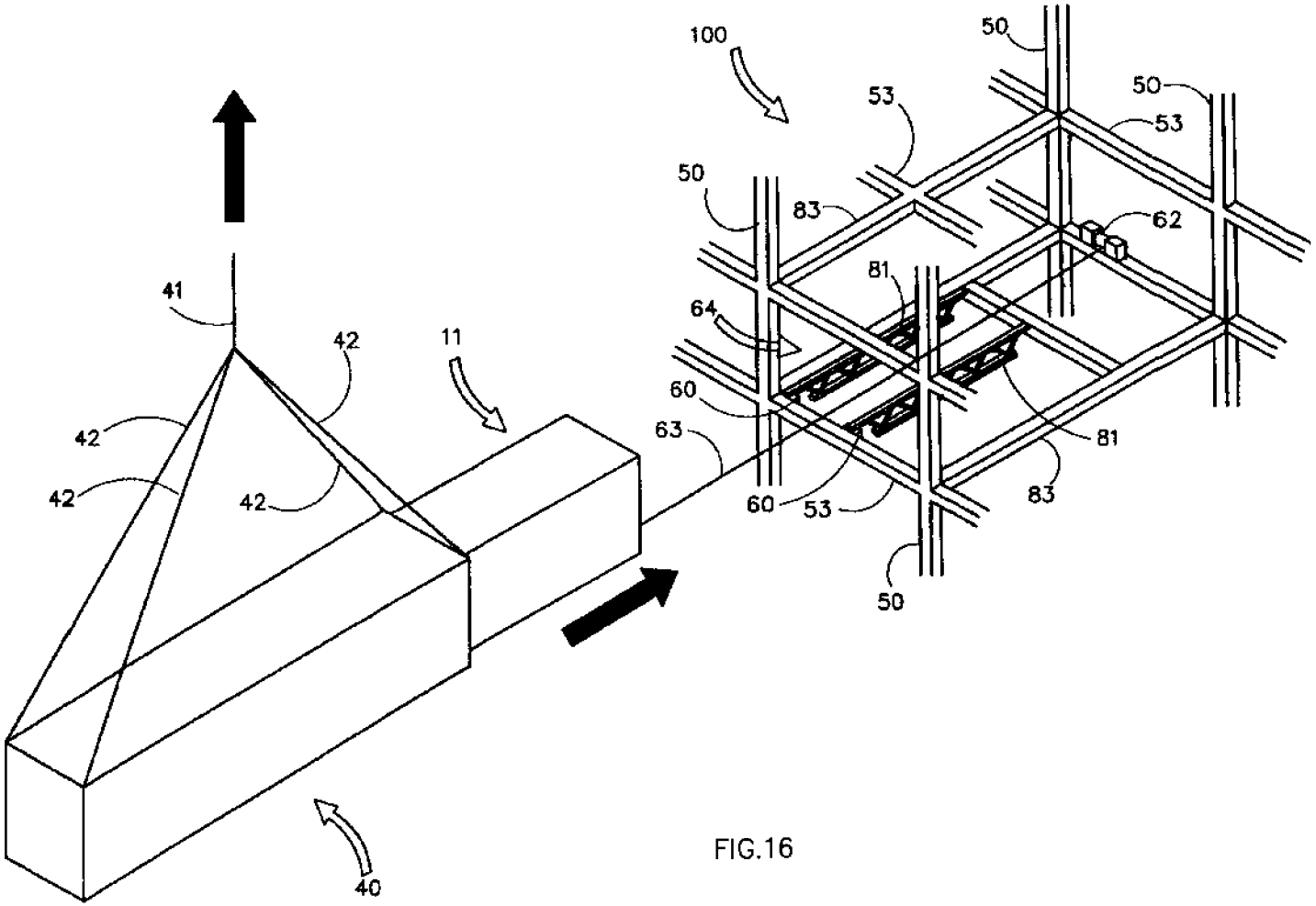
FIG. 16 is a perspective view of a support structure having one module attached to the support structure and one module in position to be placed on a support structure.

Building structural frame support 100 forms one or more bays 64 generally wide enough to receive two modules 11 therein side by side, as shown in FIG. 16. Bay 64 may be configured as desired and may hold 1, 2, 3, or more modules 11.

When module 11 arrives at the building site, building structural frame support 100 has been constructed and arranged to receive one or more modules 11. If more than one module 11 is to be installed, then the modules generally would be connected to form a larger enclosure, either side to side or end to end, top to bottom, or some combination thereof. Modules 11 are designed to fit within building structural frame support 100 and container 40.

Figure 1:
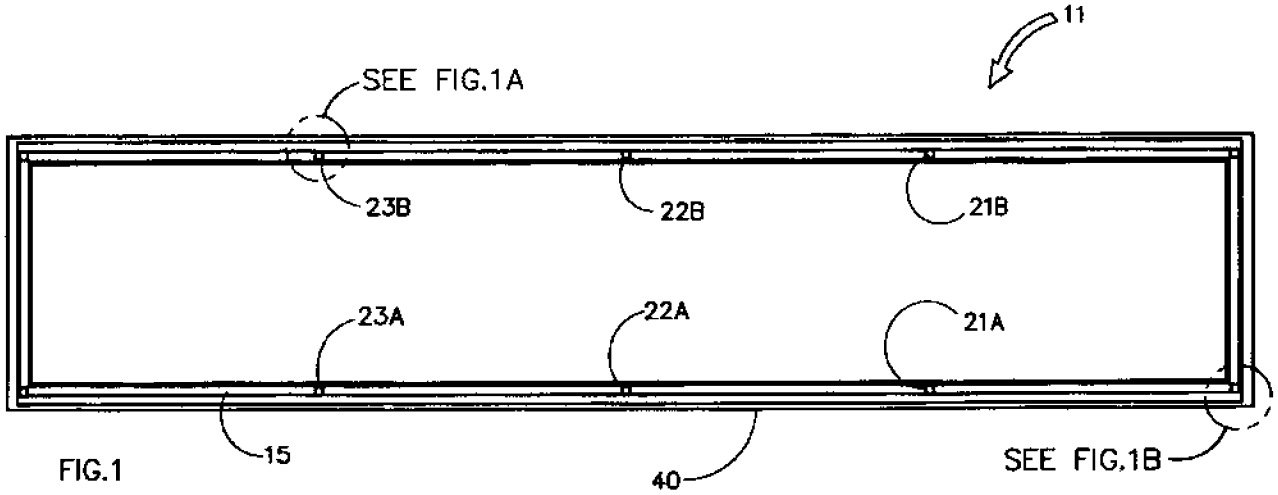
FIG. 1 is top view of a module.
Figure 2:
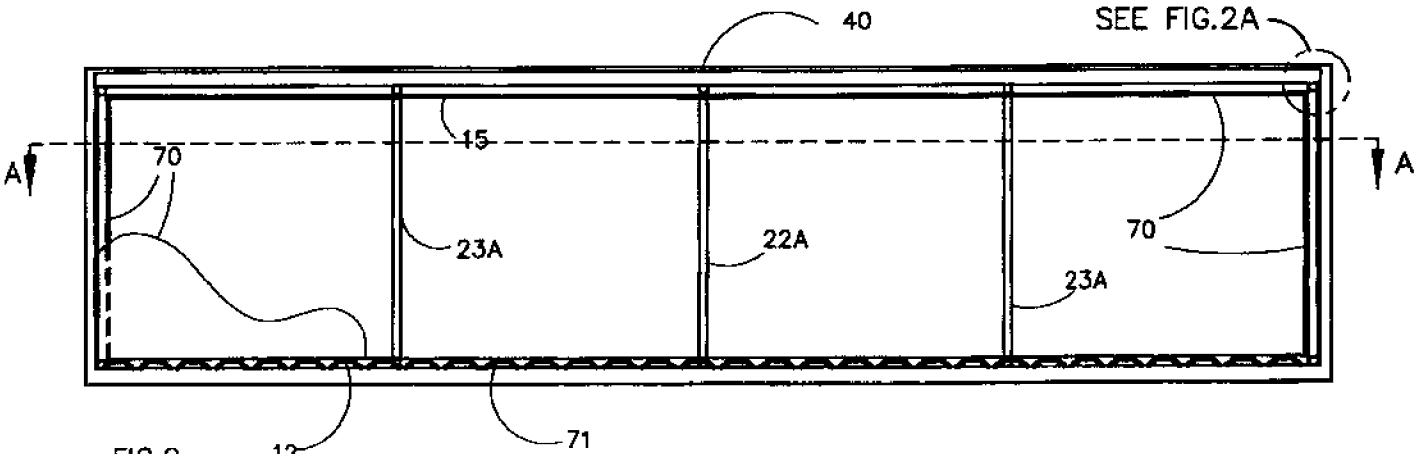
FIG. 2 is a side view.
Figure 1A:
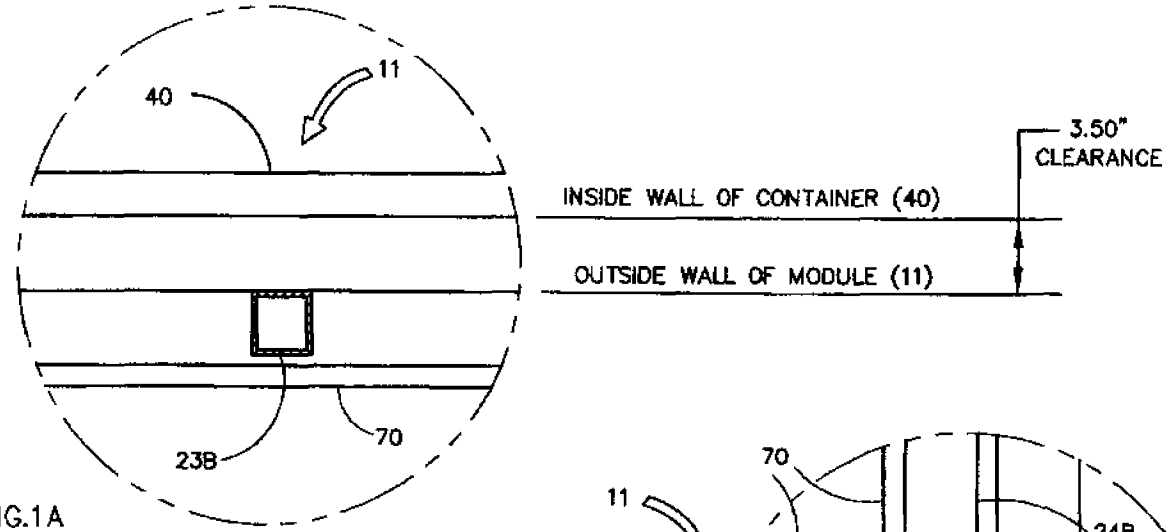
FIG. 1A shows a view of a referenced portion of the module shown in FIG 1.
Figure 1B:
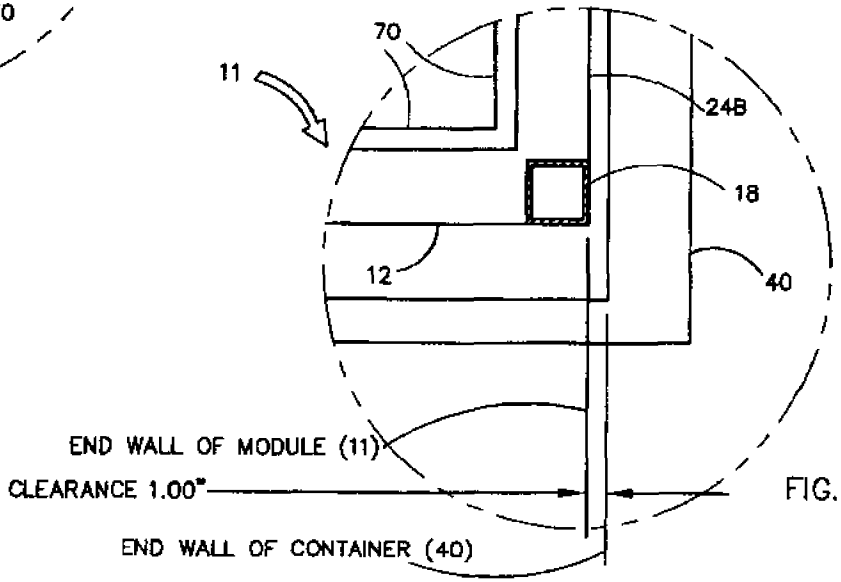
FIG. 1B shows a view of another referenced portion of the module shown in FIG. 1.
Figure 2A:
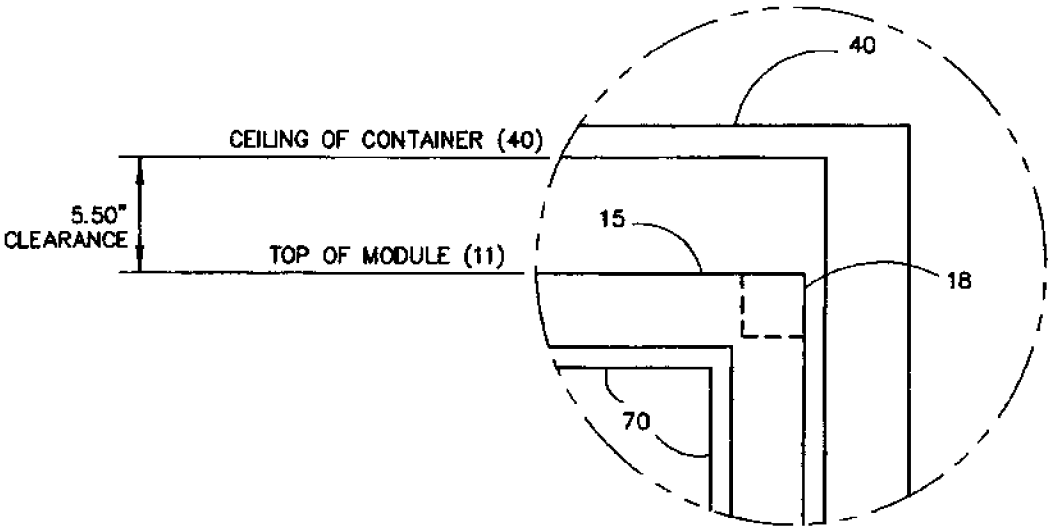
FIG. 2A shows a view of a referenced portion of the module shown in FIG. 2
Figure 4:
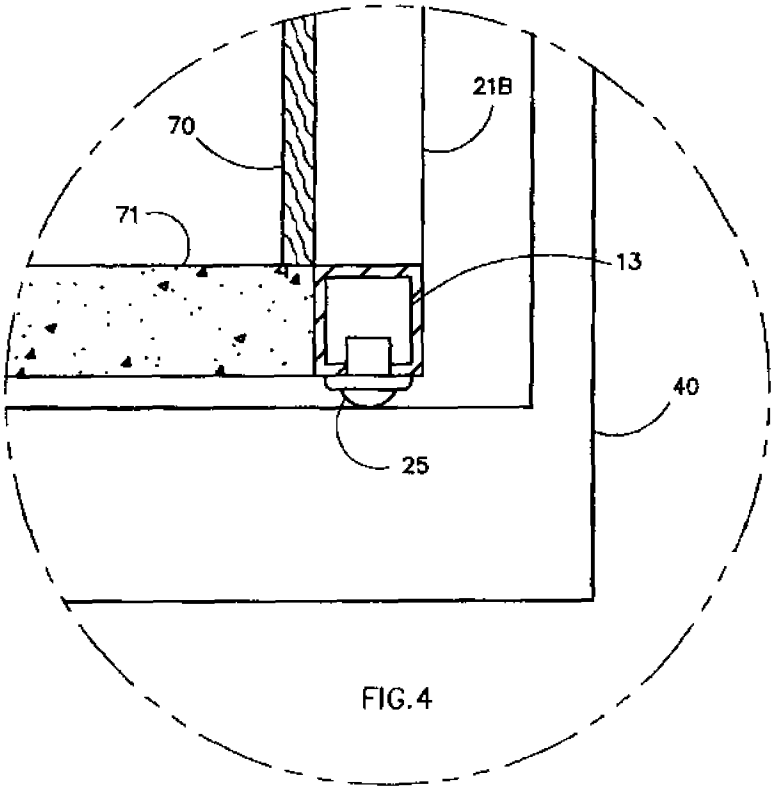
FIG. 4 is an expanded view of Detail "A" from FIG. 3.
Figure 3:
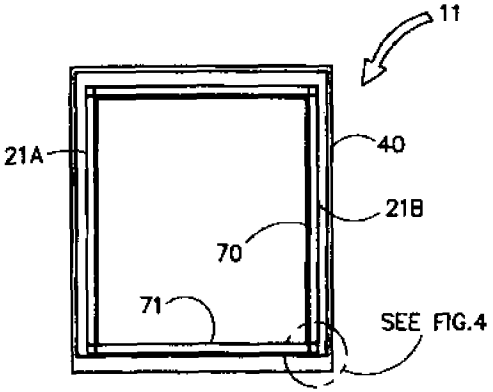
FIG. 3 is an end view of a module.
Figure 12:
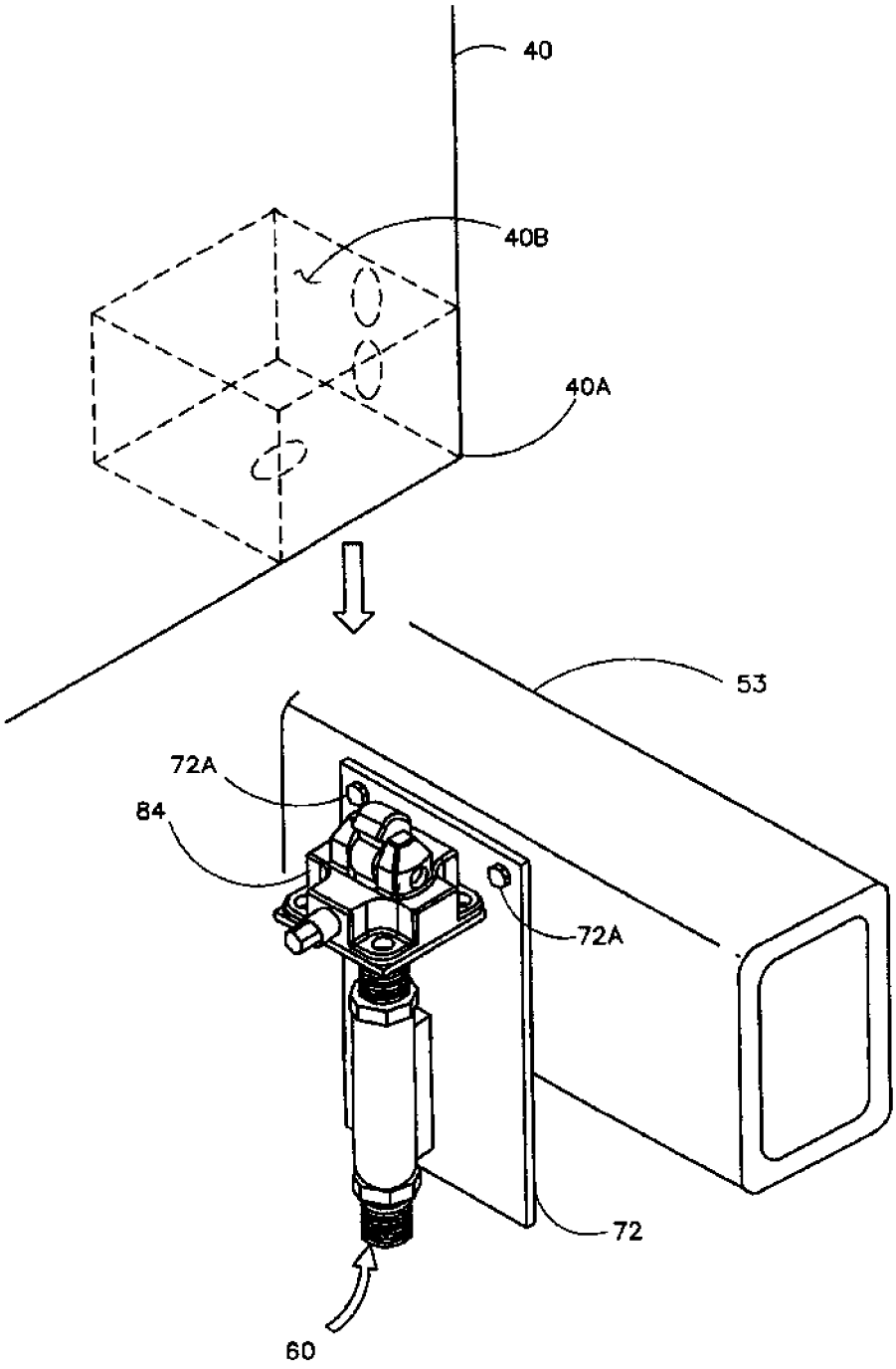
FIG. 12 is perspective view of a jack screw attached to a support structure to secure a shipping container into an unloading position.

Referring to FIG. 3 intermodal container 40 is lifted in place by a crane (not shown) and held by ties 41 and 42 connected to the crane or other appropriate lifting device. Before being lifted by a crane having ties 42, the doors (not shown) of container 40 are opened in order to slidably remove module 11. The crane lifts container 40 and moves it toward building structural frame support 100. As shown in FIG. 12, Container 40 is then secured to building structural frame support 100 along horizontal beam 53 with a conventional tandem lock 84 (as is commonly known) that is mounted on jack screw 60 and mounted to horizontal beam 53 with mounting plate 72. Container 40 has lower corner portion 40*a* and connecting region 40*b* that interacts, as is commonly known, with tandem lock 84 in order to secure container 40 into a fixed position. Once container 40 is secured into position, module 11 may be removed from container 40 and moved into bay 64 of building structural frame support 100.

Crane tie 41 continues to support/hold container 40 in place for the unloading of module 11. At the module delivery site, module 11 is transferred into building structural frame support 100 by winching cables or other means known in the art to draw module 11 from its container 40 into a predetermined location in structure 100. Module 11 is raised to substantially the same height as the desired beam 53 in which module 11 is to be placed. Prior to withdrawing from the shipping container, temporary joists 81 are placed in various predetermined locations along longitudinal beams 83.

Figure 14:
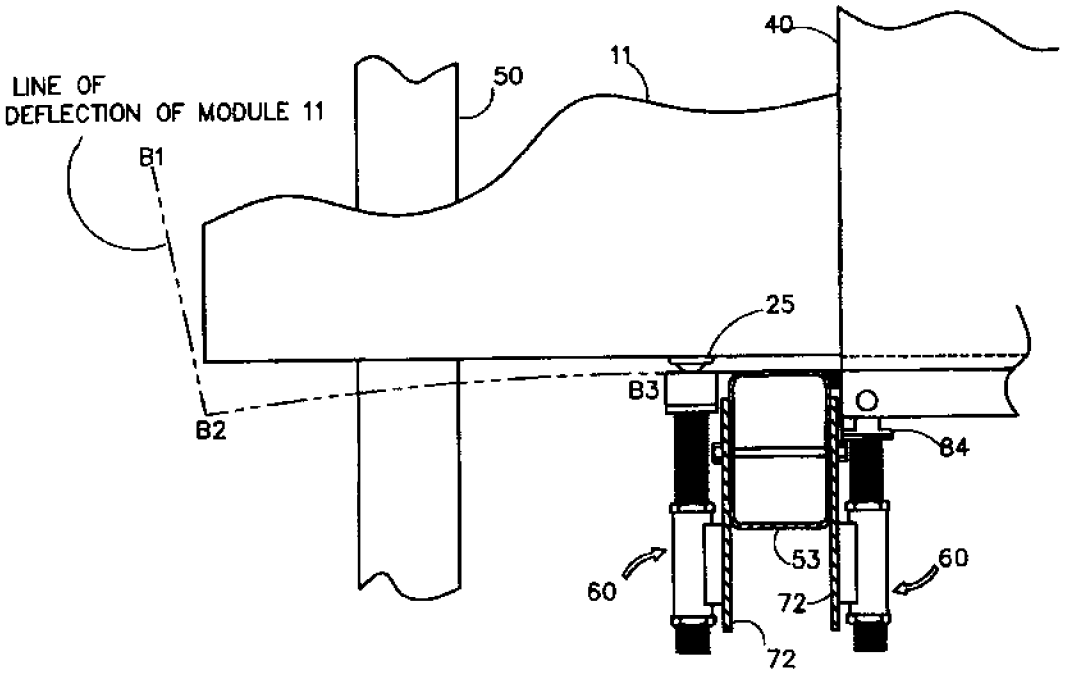
FIG. 14 is a partial side view showing a module being unloaded onto a support structure without the use of temporary joists to show deflection.
Figure 15:
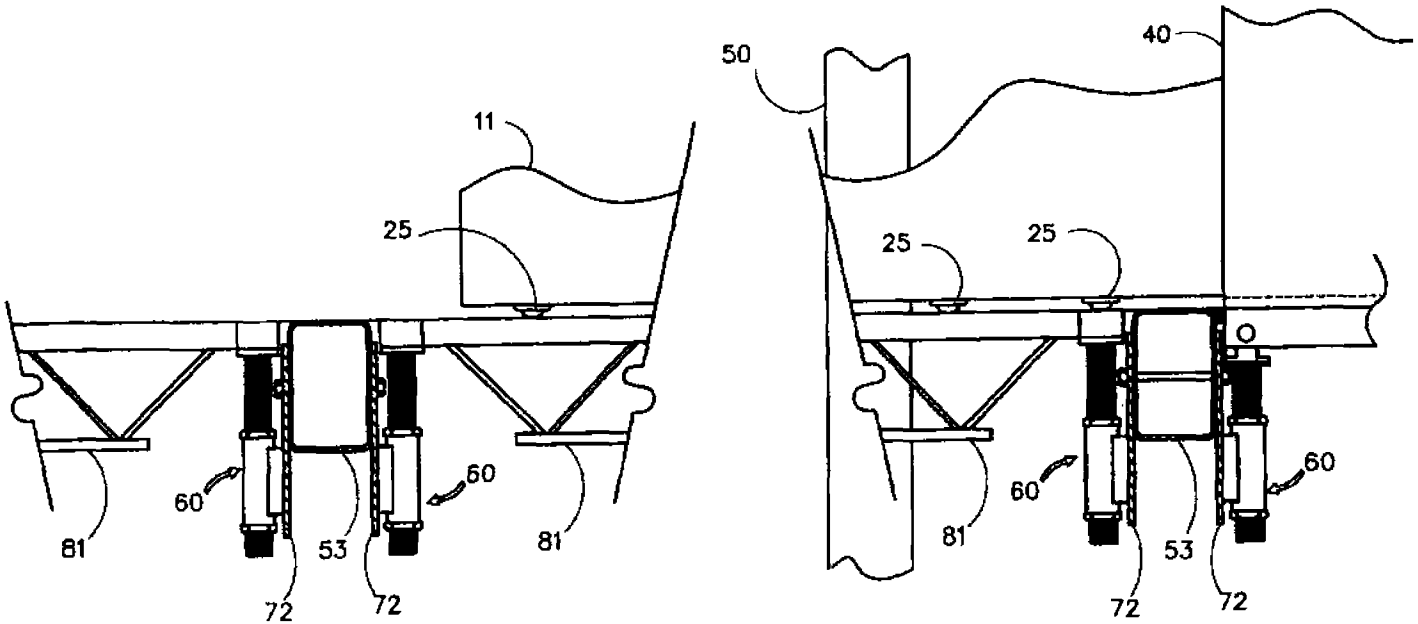
FIG. 15 is a partial side view showing a module being unloaded onto a support structure with the use of temporary joists.

As shown in FIGS. 14 and 15, temporary joists 81 are needed in the present invention because without the temporary joists 81, as seen in FIG. 14, module 11 will exhibit a line of deflection B1-B2-B3 due to weight and gravity of being unsupported at its leading edge. This deflection also referred to as cantilever stress will be present in any type of modular construction where the modules are not structural modules. As discussed above, structural modules use their own individual frames for overall structural support. Structural modules are limited in how tall the overall structure can finally accomplish. The line of deflection not only may damage module 11, but will present difficulties during installation because the amount of deflection may cause module 11 to move below the upper surface of subsequent horizontal beams 53 during installation.

It is intended that the module will be drawn out of the shipping container 40 by the aforesaid winch and cable and shall traverse over the temporary joists 81 to its final location. Module 11 is pulled from container 40 by a removable winching system 62 having steel cable 63 (or a chain). Module 11 rides or glides on the ball transfers 25 along temporary joists 81 until fully withdrawn from container 40 and module 11 is in position on building structural frame support 100.

Figure 9:
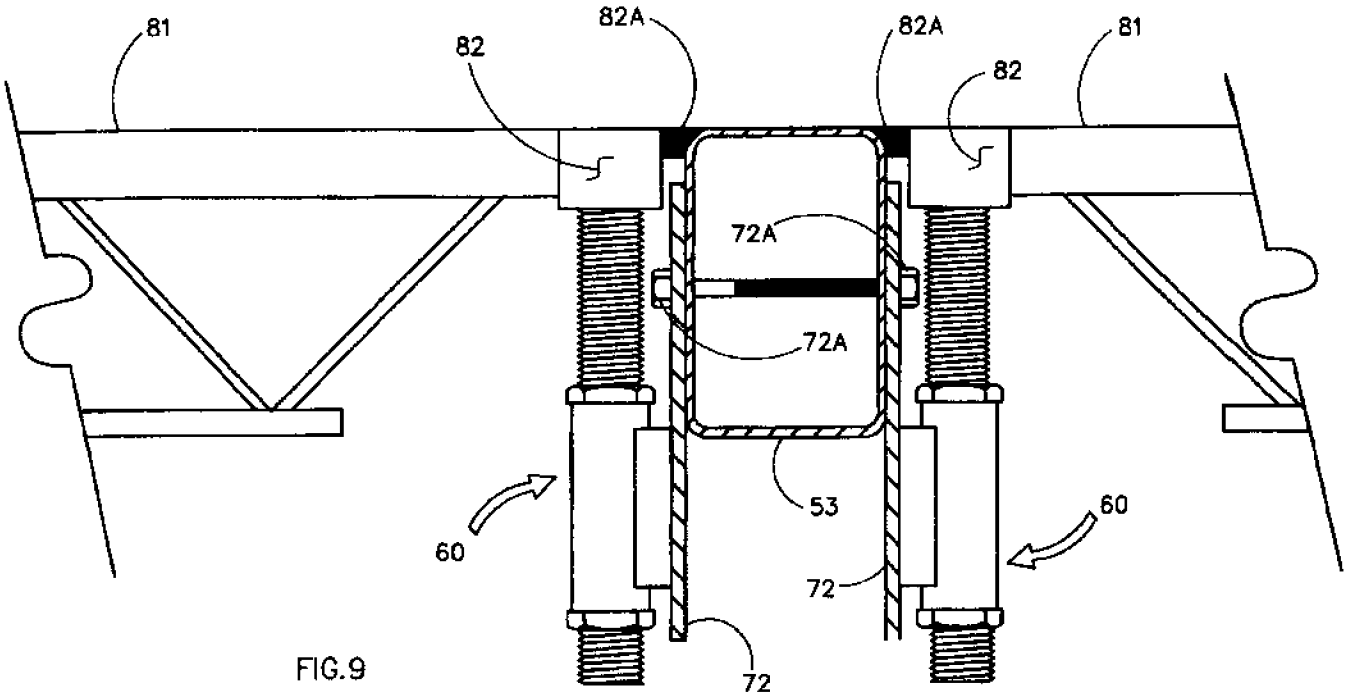
FIG. 9 is a side view of two temporary joists placed at cross beams.

Thereafter, the jack screws 60 that are placed on either side of horizontal beam 53, as shown in FIG. 9, are turned to lower the temporary joists 81 until such time that the module 11 comes into contact or near contact with the horizontal beam 53 of the building frame 100. Also shown in FIG. 9 are spacers 82*a* that may be placed as needed between joist 81 and horizontal beam 53. Said spacers 82*a* provide a contiguous surface on which ball transfers 25 may roll, so that module 11 moves into position on building structural frame support 100. Shims and blocking, as are commonly known, are then used to finally level and secure module 11 to building structural frame support 100.

Figure 8:
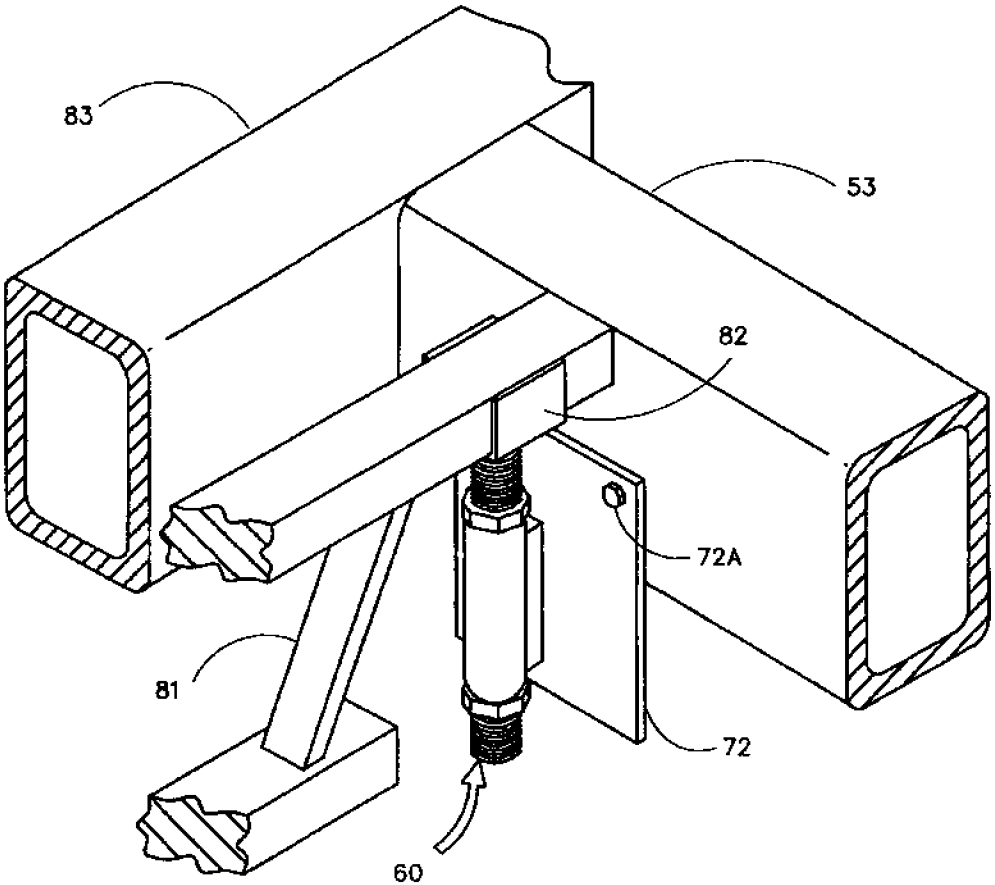
FIG. 8 is an enlarged partial view of a jack screw and temporary joist.

Each temporary joist 81 is supported by a joist support bracket 82, as seen in FIG. 8. On the joist support bracket is mounted a jack screw assembly 60 that is attached to horizontal beam 53 with support plate 72 with bolts 72*a* or any other acceptable securing mechanism.

Figure 10:
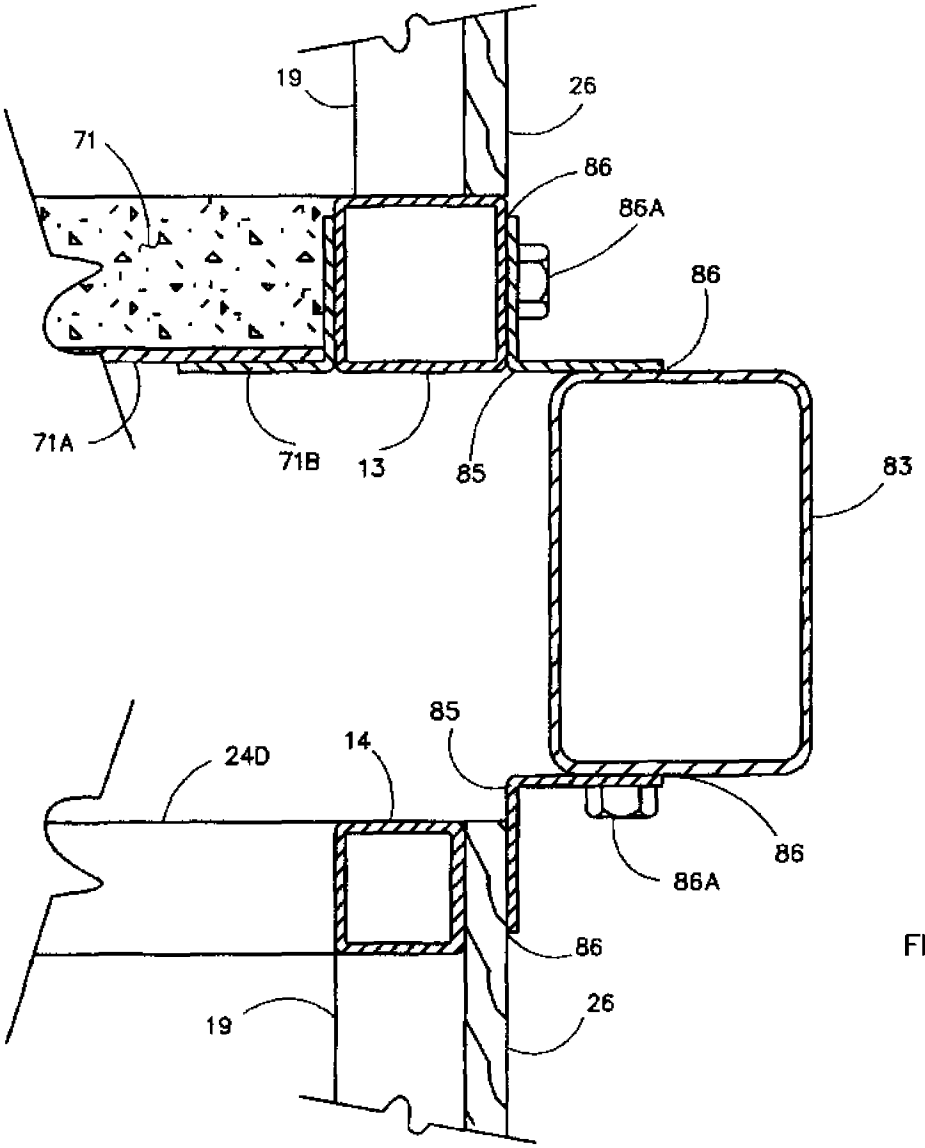
FIG. 10 is side view close up view of two module corners in position with a support frame.
Figure 13:
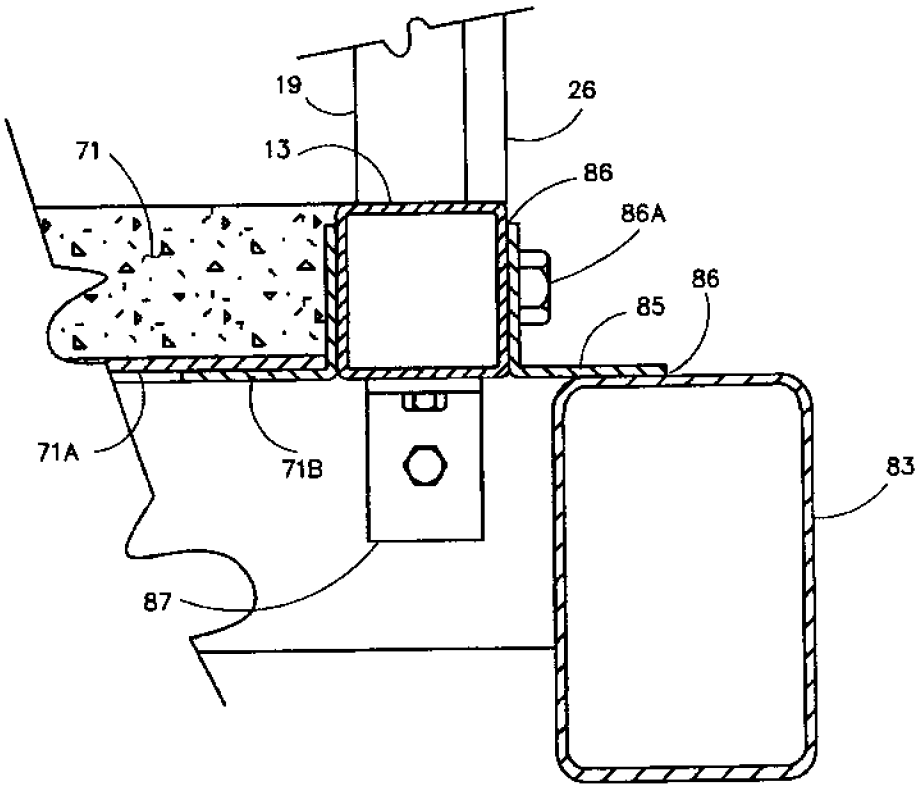
FIG. 13 is a partial side view of the module secured onto a support structure.

As shown in FIGS. 10 and 13, module 11 rests only on horizontal beams 53 and does not rest on longitudinal beams 83. Module 11 is secured to horizontal beams 53 by any desired means. In a preferred embodiment, module 11 is welded or bolted to beams 53. A trim angle 85 is attached to module 11 and longitudinal beam 83 in order to close a resultant gap when module 11 is positioned on building structural frame support 100. Trim angle 85 may be attached with one or more bolts 86*a*, or may be welded into position or attached in any other acceptable manner as is known. Trim angle 85 is then sealed with caulk 86 or other appropriate sealant thus creating a weather and watertight building envelope.

In an arrangement with two modules 11, second module 11 is drawn into position next to a first module 11. There will be a small gap between the first module 11 and second module 11. The gap is closed by drawing the two modules together tight by drawing the second module 11 to the first module 11. The second module 11 is then lowered into position, and secured as previously described to the building structural frame support 100. The two units can also be spot-welded together.

As known in the art, the interior and exterior of the module at the factory will be partially or completely finished. Specifically, subject to the application, transportation and the environment, but typically it would include the interior walls already being finished, dry-walled and primed, flooring, all electrical lights, and plumbing with minor touchup on finishing, including cabinets, plumbing fixtures, lighting fixtures, and ceiling. All internal environment can be finished at the factory with the exception of a finished wood floor due to the need for air conditioning to maintain the wood floor in transit so that it does not buckle or warp. The bathrooms may be tiled and trimmed out with fixtures.

The carpeting could be in the delivered module 11 and then rolled out over the marriage points between adjoining modules 11, and completed. If tiled, the tile would be made up to the marriage point, and then could be finished with the last pieces at the building site.

The present invention has created and eliminated the forming and pouring of concrete floors at the site. In a preferred embodiment, module 11 has lightweight concrete flooring 71 supported by steel.

It is estimated that a 30,000 square foot structure having a size of thirty units in a building and seven stories, normally takes fourteen months to be completed based on a current construction project by the inventor using the present system, subject, of course, to local inspections.

It is estimated that using the present invention, it could take between one and three months to assemble a seven story, thirty unit building, comprising thirty-thousand square feet of living space, where in each container is three-hundred square feet.

Additionally, construction costs using the module, system and method of the present invention may by reduced by 30-70%.

Once building structural frame support 100 components are delivered to a building site, it is estimated it would take one to two weeks to assemble building structural frame support 100. It is estimated building modules 11 can be installed into frame 100 at the rate of 4 per day, or more. Thus, it would be twenty-five working days to load one hundred modules using the present invention.

In a typical prior building construction site, forty laborers of various trades would construct the building and the interiors of the apartments. Inherent therein is the continuous uploading to the building site of all of the materials, including raw materials to each floor of a multi-story building. In the present invention all of the construction and building materials are delivered to a single factory and assembled into the modules 11, thus it is no longer necessary to expend work energy to bring those building materials up multiple stories of a building to the building location.

Further, a worker is now in one place on an assembly line, instead of having to move through a building, floor by floor, and location by location. Better coordination of trades results and less waste at the site, in a controlled building environment, and no weather problems.

The factory with its employees can build for any location, and the module 11 can be shipped anywhere to any building site.

It is anticipated that the exterior cladding will be attached to the exterior portions of the steel module in the factory. All gaps and fittings would be trimmed out, caulked, and sealed. Between each housing unit, there will be a void.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A method for constructing a building using a building structural support frame and a plurality of building modules comprising:

constructing, at a building site, a building structural frame comprising horizontal and vertical beams joined such that a plurality of bays exist between the horizontal beams and the vertical beams;

positioning an intermodal shipping container, having a building module included inside the intermodal shipping container where the inside of the intermodal shipping container lacks a pallet, adjacent to one of the bays of the building structural frame;

opening doors of the intermodal shipping container in order to slideably remove the building module;

securing the intermodal shipping container to the building structural frame via a coupler between the intermodal shipping container and the building structural frame; and once the intermodal shipping container is secured to the building structural frame with its doors open, slideably removing the building module from the container through the open doors of the intermodal shipping container and sliding the building module from the intermodal shipping container directly into the bay until the building module is outside the intermodal shipping container and until the building module is fully supported within the bay by the building structural support frame, wherein the building is a multiple story building having bays for insertion of the building modules at each story, said method further comprising:

installing a plurality of building modules within the plurality of bays, starting at the topmost story bays and working downwards, so that the uppermost building modules are installed within the building first.

2. The method of claim 1, further comprising:

placing a roof on the building structure frame support prior to insertion of any of the building modules within the building structural support frame.

3. The method of claim 1, wherein the building module has a floor, at least one finished interior wall, outer cladding, and exterior wall cladding, wherein when the building module is placed in the bay of the building structural support frame, forms at least a portion of the floor, and walls of the building in the position of the bay within which the building module was inserted, and wherein the outer cladding and exterior wall cladding forms an exterior surface of a portion of the building.

4. The method of claim 1, wherein each of the bays formed between the vertical beams and the horizontal beams is wide enough to permit two or more building modules to be placed within the bay side by side with each other, said method further comprising:

positioning a different container, having a different building module included inside the different container, to the bay within which the building module was inserted;

slideably removing the different building module from the different container and sliding the different building module from the different container directly into the bay until the different building module is outside the different container and until the different building module is fully supported within the bay by the building structural support frame; and joining the different building module to the building module to form a continuous floor for an interior space having an interior area approximately equal to the interior area of the bay.

5. The method of claim 1, wherein the building is a multistory building, and wherein the bay is a bay for a story greater than the first story of the building, said method further comprising:

when positioning the container, lifting the intermodal shipping container off the ground to a position adjacent to the bay; and sliding the building module horizontally from the intermodal shipping container to the bay.

6. The method of claim 1, further comprising:

installing temporary joists along predetermined locations along longitudinal beams of the building structural frame, so that the temporary joists are able to support the building module when the building module is slid into the bay from the container; and removing the temporary joints after the building module is fully supported within the bay by the building structural support frame.

7. The method of 1, further comprising:

attaching at least four rollers to the underside of said building module for rolling the building module from the container to the bay.

8. The method of claim 1, wherein each building module is substantially complete and includes electrical components and wiring and plumbing and plumbing connections.

9. The method of claim 1, further comprising:

constructing, at a factory location remote from the building site, the building module;

placing rollers on the underside of said building module;

rolling the building module into the intermodal shipping container; and shipping the intermodal shipping container, having a building module included inside the intermodal shipping container, from the factory location to a building site.

10. The method of claim 1, wherein the intermodal shipping container has a distance under a door header of approximately eight feet five inches, wherein an interior floor to ceiling height of the building module is between seven feet nine inches and seven feet eleven inches.

11. The method of claim 1, wherein the building module comprises a finished interior and exterior.

12. The method of claim 1, wherein the building module includes interior walls that are finished, dry-walled and primed, flooring, plumbing with minor touchup on finishing, cabinets, plumbing fixtures, lighting figures, electrical wiring, and finished exterior wall cladding that is to face the outside of the building when installed.

13. The method of claim 1, wherein the building is a multiple story building having bays for insertion of the building modules at each story, said method further comprising:

installing a plurality of building modules within the plurality of bays, starting at the topmost story bays and working downwards, so that the uppermost building modules are installed within the building first, wherein said building modules comprise electrical wiring, and plumbing, plumbing fixtures, and electrical fixtures installed when shipped, wherein electrical and plumbing connectors between modules are positioned close to an outer edge of the building module, wherein workers are able to access electrical and plumbing connections in a space between vertically adjacent building modules, as the building modules are being installed.

14. A method for constructing a building using a building structural support frame and a plurality of building modules comprising:

constructing, at a factory location remote from a building site, a building module;

rolling the building module into an intermodal shipping container;

shipping the intermodal shipping container, having a building module included inside the container, from the factory location to a building site;

constructing, at the building site, a building structural frame comprising horizontal and vertical beams joined such that a plurality of bays exist between the horizontal beams and the vertical beams;

positioning the intermodal shipping container, having the building module included inside the intermodal shipping container, adjacent to one of the bays of the building structural frame;

opening doors of the intermodal shipping container in order to slidably remove the building module;

securing the intermodal shipping container to the building structural frame via a coupler between the intermodal shipping container and the building structural frame; and once the intermodal shipping container is secured to the building structural frame with its doors open, slideably removing the building module from the container through the open doors of the intermodal shipping container and sliding the building module from the intermodal shipping container directly into the bay until the building module is outside the intermodal shipping container and until the building module is fully supported within the bay by the building structural support frame.

15. A method for constructing a building using a building structural support frame and a plurality of building modules comprising:

constructing, at a building site, a building structural frame for a multiple story building comprising horizontal and vertical beams joined such that a plurality of bays exist between the horizontal beams and the vertical beams;

lifting an intermodal shipping container, having a building module included inside the intermodal shipping container, adjacent to one of the second story or higher bays of the building structural frame, wherein the intermodal shipping container has a distance under a door header of approximately eight feet five inches, wherein an interior floor to ceiling height of the building module is between seven feet nine inches and seven feet eleven inches, wherein each building module is substantially complete and includes electrical components and wiring and plumbing and plumbing connections;

opening doors of the intermodal shipping container in order to slideably remove the building module;

securing the intermodal shipping container to the building structural frame via a coupler between the intermodal shipping container and the building structural frame;

once the intermodal shipping container is secured to the building structural frame with its doors open, slideably removing the building module from the container through the open doors of the intermodal shipping container and sliding the building module from the intermodal shipping container directly into the bay until the building module is outside the intermodal shipping container and until the building module is fully supported within the bay by the building structural support frame;

installing temporary joists along predetermined locations along longitudinal beams of the building structural frame, so that the temporary joists are able to support the building module when the building module is slid into the bay from the container;

removing the temporary joints after the building module is fully supported within the bay by the building structural support frame;

placing a roof on the building structure frame support prior to installation of any of the building modules within the building structural frame; and installing a plurality of building modules within the plurality of bays, starting at the topmost story bays and working downwards, so that the uppermost building modules are installed within the building first.

* * * * *